US006525475B2

(12) United States Patent
Schölz et al.

(10) Patent No.: US 6,525,475 B2
(45) Date of Patent: Feb. 25, 2003

(54) $SiO_2$-GLASS BULB WITH AT LEAST ONE CURRENT LEAD-IN, PROCESS FOR PRODUCING A GAS-TIGHT CONNECTION BETWEEN THEM, AND THEIR USE IN A GAS-DISCHARGE LAMP

(75) Inventors: Friedhold Schölz, Rodenbach (DE); David Lupton, Gelnhausen (DE); Jörg Schielke, Bruchkobël (DE); Holger Zingg, Biebergemünd (DE)

(73) Assignee: W. C. Heraeus GmbH & Co. KG, Hanau (DE)

( * ) Notice: Subject to any disclaimer, the term of this patent is extended or adjusted under 35 U.S.C. 154(b) by 0 days.

(21) Appl. No.: 09/919,018

(22) Filed: Jul. 31, 2001

(65) Prior Publication Data

US 2002/0030446 A1 Mar. 14, 2002

(30) Foreign Application Priority Data

Aug. 4, 2000 (DE) ..... 100 38 841

(51) Int. Cl.[7] ..... H01J 17/18; H01J 61/36
(52) U.S. Cl. ..... 313/625; 313/623
(58) Field of Search ..... 313/623, 624, 313/625, 332, 572, 573, 574

(56) References Cited

U.S. PATENT DOCUMENTS 3,753,026 A 8/1973 Goorissen
5,404,078 A * 4/1995 Bunk et al. ..... 313/625
5,932,969 A 8/1999 Ikeuchi et al.
6,169,366 B1 * 1/2001 Niimi ..... 313/633

FOREIGN PATENT DOCUMENTS

| | | |
|---|---|---|
| DE | 197 30 137 | 1/1998 |
| EP | 0 074 507 | 3/1983 |
| EP | 0 930 639 | 7/1999 |
| EP | 0 938 126 | 8/1999 |
| FR | 1 513 773 | 1/1968 |
| GB | 10 74 124 | 6/1967 |
| JP | 09 115 484 | 5/1997 |
| JP | 101 25 284 | 5/1998 |

* cited by examiner

*Primary Examiner*—Nimeshkumar D. Patel
*Assistant Examiner*—Thelma Sheree Clove
(74) *Attorney, Agent, or Firm*—Cohen, Pontani, Lieberman & Pavane

(57) ABSTRACT

An $SiO_2$-glass bulb with at least one current lead-in made of a gas-tight composite material, such that the composite material consists of a noble metal with a melting point >1,700° C. and $SiO_2$ and is at least partially coated with a layer of $SiO_2$. The noble metal and the $SiO_2$ are homogeneously distributed in the composite material. The noble metal content of the composite material is ≧10 vol. % to ≦50 vol. %, and the $SiO_2$ coating covers the composite material at least in the region of the connection with the $SiO_2$-glass bulb.

14 Claims, 1 Drawing Sheet

$SiO_2$-GLASS BULB WITH AT LEAST ONE CURRENT LEAD-IN, PROCESS FOR PRODUCING A GAS-TIGHT CONNECTION BETWEEN THEM, AND THEIR USE IN A GAS-DISCHARGE LAMP

BACKGROUND OF THE INVENTION

The invention concerns an $SiO_2$-glass bulb with at least one current lead-in made of a gas-tight composite material, such that the composite material consists of a noble metal with a melting point >1,700° C. and $SiO_2$ and is at least partially coated with a layer of $SiO_2$. The invention also concerns a high-intensity discharge lamp and a process for producing a gas-tight connection between an $SiO_2$-glass bulb and a current lead-in.

Metallic or composite current lead-ins for $SiO_2$-glass bulbs are well known. The term composite is understood to mean a combination of different types of materials. In the present case, we are concerned, specifically, with a combination of a glass material and a metallic material. In the formation of a gas-tight connection between the material $SiO_2$ and an electrically conducting, metallic or metal-containing current lead-in, it is necessary to deal with the basic problem that the metal components of the current lead-in are poorly wetted by viscous $SiO_2$. In addition, the low coefficient of thermal expansion of $SiO_2$ compared to that of a metal makes it difficult to form a gas-tight connection. During the cooling process after sealing, the metallic or metal-containing current lead-in contracts more strongly than the $SiO_2$ of the glass bulb, so that there is a tendency for a gap to form at the interface between the glass bulb and the current lead-in. Although this risk can be reduced by minimizing the thickness of the current lead-in, it is difficult to position and handle very thin current lead-ins, e.g., in the form of foil. To be able to produce a gas-tight connection despite these problems, only relatively expensive solutions have been proposed so far.

For example, EP 0,938,126 A1 describes a current lead-in made of a composite material for a lamp, especially a discharge lamp, in which the composite material consists of $SiO_2$ and metal, and in which the metal content changes along the length of the current lead-in. The metal content can vary from 0 to 100%. The end with the low molybdenum content is directed towards the discharge space of the lamp and is connected with the lamp bulb in a gas-tight connection. Only the front end of the current lead-in, which consists mainly or entirely of $SiO_2$, is in direct contact with the gas in the discharge space. A metallic electrode mount is sintered into the current lead-in on the end with the low metal content. This mount is inserted deep enough into the current lead-in to produce direct contact with a composite region in which the $SiO_2$ content is ≧80%. This produces an electrical contact between the electrode mount and the metal-rich end of the current lead-in. The composite material disclosed in the cited document consists of a metal powder that consists of molybdenum with an average particle size $d_{50}$ of 1 $\mu$m and a glass powder with an average particle size $d_{50}$ of 5.6 $\mu$m.

EP 0,930,639 A1 likewise discloses a current lead-in with a metal content that changes along its length and an $SiO_2$ lamp bulb. Metals that are specified as suitable for the composite material include not only molybdenum, but also tungsten, platinum, nickel, tantalum, and zirconium. To protect the metal-rich end of the current lead-in from oxidation, a protective coating of glass, metal oxide, noble metal, or chromium is provided, which partially covers the part of the current lead-in that extends out of the lamp bulb. The gas-tight seal between the current lead-in and the lamp bulb is located in a region of the current lead-in in which the concentration of the metal in the composite material is less than 2%.

However, the production of a current lead-in with a metal concentration that changes along the length of the current lead-in requires expensive equipment. Different powders must be produced and arranged in layers. In addition, when an electrode is being sealed into the current lead-in, it is necessary to consider the electrical conductivity of the individual layers and thus the depth of insertion of the electrode in the current lead-in in order to produce a solid electrical contact. To be able to achieve a gas-tight connection, the sealing with the $SiO_2$ lamp bulb must be performed in a specific segment of the length of the current lead-in with a very low metal concentration. Furthermore, at high temperatures in the region of the current lead-in, corrosion can occur in metals that are not resistant to oxidation, such as molybdenum.

EP 0,074,507 A2 describes a material for electrical contacts, especially light-duty contacts, and a process for producing it. The material consists of a noble metal with 1 to 50 vol. % of glass, in which a noble metal powder with a particle size of ≦250 $\mu$m and a glass powder with an average particle size of ≦50 $\mu$m are preferably used. Gold, silver, palladium and their alloys are used as the noble metals.

SUMMARY OF THE INVENTION

The object of the present invention is to provide a gas-tight, corrosion-resistant current lead-in for an $SiO_2$-glass bulb, preferably a discharge lamp, which has high electrical conductivity and is easy to produce and handle.

Pursuant to this object, and others which will become apparent hereafter, one aspect of the present invention resides in the noble metal and the $SiO_2$ being homogeneously distributed in the composite material. The noble metal content of the composite material is ≧10 vol. % to ≦50 vol. %, and the $SiO_2$ coating covers the composite material at least in the region of the connection with the $SiO_2$-glass bulb.

The $SiO_2$ used to produce the composite material should have a purity of ≧97 wt. %. Accordingly, impurities in the $SiO_2$, e.g., alkali metals or alkaline-earth metals, can be tolerated up to ca. 3 wt. %.

Due to the $SiO_2$ coating, the current lead-in can be sealed gas-tight with the $SiO_2$-glass bulb along its entire length or along any desired segment of this length. Only a single composite powder is needed to produce the current lead-in. Since the current lead-in shows uniformly high electrical conductivity along its entire length, when an electrode is sealed into the current lead-in, it is not necessary to consider its depth of penetration into the composite material. The proportion of noble metal in the current lead-in can be used to adjust the coefficient of thermal expansion, which is preferably selected in the range of $<5\cdot10^{-6}$ 1/K for the current lead-in. The current lead-in of the invention has the especially advantageous property that the $SiO_2$-containing composite material of which it is made, which has a noble metal content of ≧10 vol. % to ≦50 vol. %, is readily deformable at temperatures greater than about 1,200° C. At temperatures greater than about 1,600° C., current lead-ins designed, for example, in the form of rods bend under their own weight to an angle of 90° without developing cracks and without impairing the electrical conductivity of the material. This property makes it possible to straighten and align a current lead-in of this type.

To be sure, these mechanical properties are similar to those of pure quartz glass, but it is surprising that they are also found in the composite material with its very high electrical conductivity and current-carrying capacity. A measured current-carrying capacity of 20 amperes in a rod of composite material with a diameter of 2 mm indicates a cohesive network of the noble metal component, which would normally be rigid and hardly deformable. These properties of the composite material, which are a combination of the deformation properties of the pure quartz glass and the conductivity of the noble metal, allow precise and very easy fitting of electrodes or contact pins to the current lead-in. For example, a tungsten electrode can be fastened to the end of the current lead-in, which points towards the inside of the glass bulb, by heating the electrode together with the powder mixture. It is also possible to sinter the electrode into composite material that has already been formed. In addition, an electrode can be inserted into viscous composite material that has been heated to about 1,200° C. In all three cases, a sufficiently conductive electrical connection is produced in a very simple fashion. A contact pin can be connected with the end of the current lead-in that is directed away from the glass bulb in the same way. The electrode or contact pin can also be aligned, i.e. its position or location can be corrected, or the straitness of the current lead-in itself can be corrected at temperatures of about 1,200° C.

The composite material is preferably formed by heating a powder mixture of noble metal powder and $SiO_2$-glass powder. The noble metal may also be a noble metal alloy. The noble metals platinum, rhodium, ruthenium, rhenium, and iridium have been found to be especially suitable for use in the composite material. The electrical conductivity of the current lead-in is preferably selected in the range of <0.01 $m/\Omega mm^2$. The thickness of the $SiO_2$ coating should be 5–25 $\mu$m and especially 7–15 $\mu$m. A noble metal powder with a BET (Brunauer-Emmett-Teller) specific surface of 0.01 to 10 $m^2/g$ is especially suitable. It is also advantageous to use a noble metal powder with an average particle size ($d_{50}$) of 3 to 30 $\mu$m. The $SiO_2$-glass powder preferably has a BET specific surface of 10 to 100 $m^2/g$. An average particle size ($d_{50}$) of the $SiO_2$-glass powder of 0.1 to 10 $\mu$m has been found to be advantageous. It is especially cost-effective if the noble metal component of the composite material is present in amounts of only 10 vol. % to 25 vol. %.

The use of the $SiO_2$-glass bulb and current lead-in of the invention is ideal for high-intensity discharge lamps due to the excellent corrosion resistance, high conductivity, and high level of gas-tightness of the lead-in.

The goal of the invention with respect to a process for producing a gas-tight connection is achieved with a process in which the powder mixture is heated to a maximum of 1,200–1,600° C. After the material has been heated, the layer of $SiO_2$ is applied to the gas-tight composite material in the region of the connection with the $SiO_2$-glass bulb. The current lead-in is inserted into an opening in the $SiO_2$-glass bulb, and the current lead-in is sealed gas-tight with the $SiO_2$-glass bulb in the region of the $SiO_2$ coating at a temperature >1,600° C. The $SiO_2$ coating is preferably applied to the composite material in the form of a paste or a suspension by spraying, printing, or dipping, after which the $SiO_2$ coating should be fired on the composite material. However, the $SiO_2$ coating may also be applied to the composite material by vacuum evaporation, sputtering, chemical deposition, or thermal spraying.

When the noble metals ruthenium and/or rhenium and/or iridium are used for the composite material, the goal of the invention with respect to a process for producing a gas-tight connection is also achieved with a process in which the powder mixture is heated to a maximum of 1,200–1,600° C. After it has been heated, the gas-tight composite material is at least partially calcined in an oxygen-containing atmosphere at a temperature ≧1,600° C., so that the noble metal on the surface of the composite material is oxidized and vaporized, and a layer of $SiO_2$ is produced at least in the region of the connection with the $SiO_2$-glass bulb of the lamp. The current lead-in is inserted into an opening in the $SiO_2$-glass bulb, and the current lead-in is sealed gas-tight with the $SiO_2$-glass bulb in the region of the $SiO_2$ coating at a temperature >1,600° C.

This process exploits the fact that the metals ruthenium, rhenium, and iridium, which form volatile oxides, are oxidized and vaporized at the surface of the composite material, when the composite material is heated to a temperature ≧1,600° C. in an atmosphere that contains oxygen. During the calcining process, a thin, closed layer of $SiO_2$ forms around the composite material and prevents further volatilization of the metal. This layer of $SiO_2$ can then be satisfactorily sealed gas-tight with the $SiO_2$ of the glass capsule. The seal is so stable mechanically that an atomic bond is probably formed between the $SiO_2$ of the glass capsule, the $SiO_2$ coating produced by the calcining, and the $SiO_2$ in the composite material.

Air is preferably used as the oxygen-containing atmosphere, but it is also possible to use pure oxygen or other gas mixtures that contain oxygen.

It is especially advantageous to increase the temperature incrementally to a maximum of 1,200–1,600° C. during the heating of the powder mixture.

A process in which the powder mixture is shaped before being heated is cost-effective. It was found to be effective to shape the power mixture by stamping or extrusion before heating it. If an unshaped powder mixture is heated (which, of course, is also possible), the composite material produced in this way must then be shaped. However, due to the high strength of the composite material, this can generally be accomplished only by machining methods, which are less cost-effective.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

BRIEF DESCRIPTION OF THE DRAWINGS

The following is intended only as an example to illustrate the object of the invention.

DETAILED DESCRIPTION OF THE INVENTION

Figure 1:
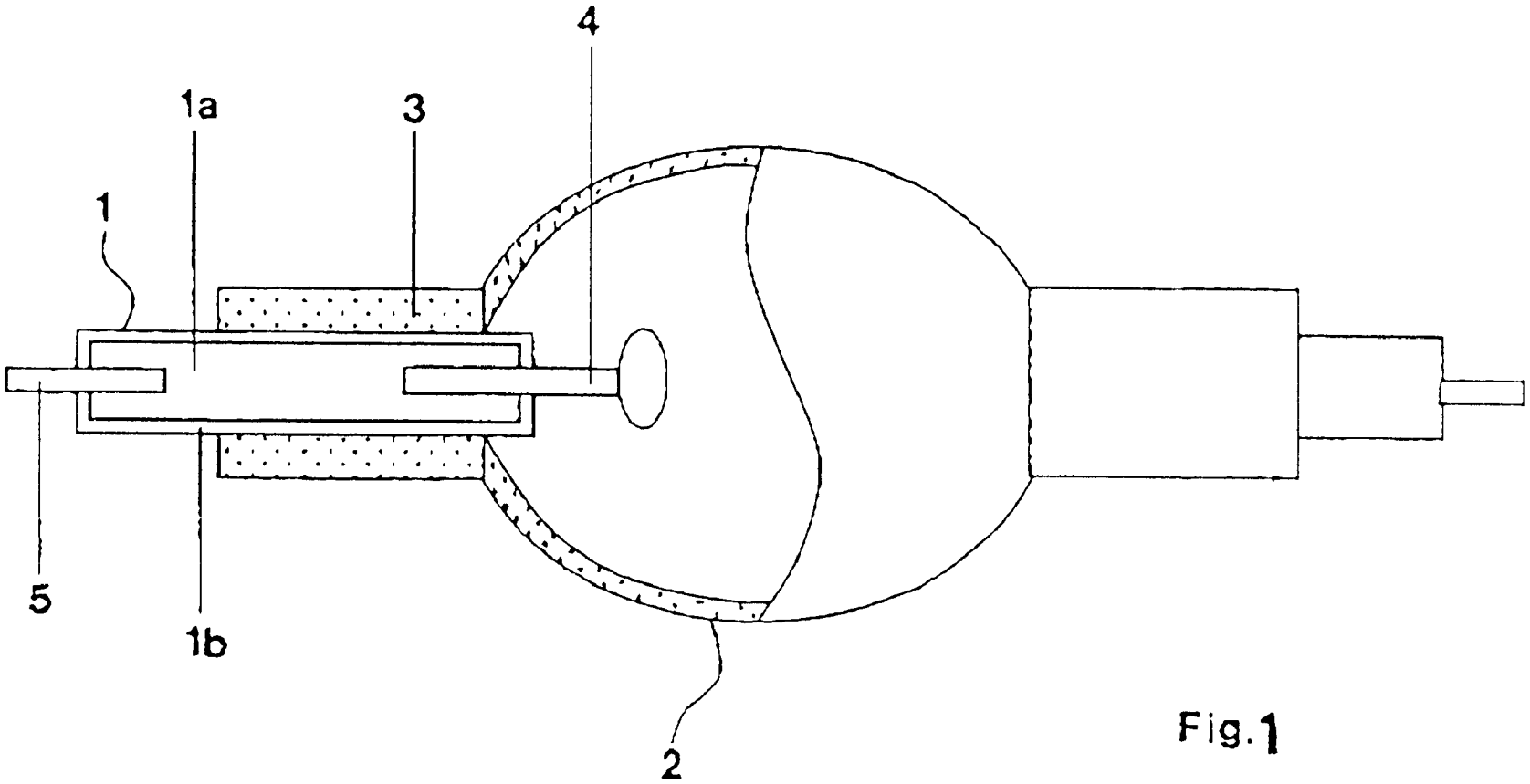
FIG. 1 shows a discharge lamp pursuant to the invention with an $SiO_2$-glass discharge vessel.

FIG. 1 shows a discharge lamp in accordance with the invention. It has a current lead-in 1 and an $SiO_2$-glass bulb in the form of a discharge tube 2. The discharge tube 2 has a tubular section 3 in the region of the current lead-in 1. The tubular section 3 has an opening in which the current lead-in 1 is sealed. The current lead-in 1 consists of a composite material 1a, which is coated with a thin layer of $SiO_2$ 1*b*. The end of the current lead-in 1 that extends into the discharge space of the discharge tube 2 has a tungsten electrode 4. The end of the current lead-in 1 that extends out of the discharge tube 2 has a molybdenum contact pin 5.

The following Examples 1–6 are provided to better explain the invention, but are only intended as examples for illustrating the object of the invention.

Example 1 describes a process for producing a current lead-in with ruthenium.

Example 2 describes another process for producing a current lead-in with ruthenium.

Example 3 describes a conductivity measurement on a current lead-in with ruthenium.

Example 4 describes a test of the current-carrying capacity of a current lead-in with ruthenium.

Example 5 describes a possible means of attaching an electrode and a contact pin.

Example 6 describes another possible means of attaching an electrode and a contact pin.

EXAMPLE 1

A noble metal powder consisting of ruthenium with a BET specific surface of 0.96 $m^2/g$ and an average particle size $d_{50}$ of 9.4 $\mu$m is used to produce the powder mixture. The $SiO_2$ used to produce the powder mixture has a BET specific surface of 53 $m^2/g$ and an average particle size $d_{50}$ of 4.4 $\mu$m. 75 vol. % of the $SiO_2$ powder and 25 vol. % of the noble metal powder are homogeneously mixed with distilled water and worked into a paste. The paste is extruded into a strand with a diameter of 2.5 mm, which is then dried in air. The dried strand is heated to 1,500° C. in an inert atmosphere, preferably argon, at a maximum heating rate of 15° C./minute. Incremental heating is realized by maintaining the material at a constant temperature for 30 minutes at 500° C., 800° C., and 1,100° C. The final temperature of 1,500° C. is maintained for 2 h. The cooled composite strand with a diameter of 1.9 mm is covered with a thin, uniform layer of a paste produced by adding distilled water to the $SiO_2$ with a BET specific surface of 53 $m^2/g$ and an average particle size of 4.4 $\mu$m. The paste is dried in air and fired on the strand of composite material at 1,550° C. for 30 minutes. The strand of composite material (or current lead-in), which is coated with a layer of $SiO_2$<0.1-mm thick, is cut to a length of 25 mm and (possibly after attachment of an electrode and a contact pin) is inserted into the tubular opening of an $SiO_2$ glass capsule. The tubular opening has an inside diameter of 2 mm and an outside diameter of 5.9 mm. The region of the tubular opening is locally heated to about 1,700° C., e.g. with a hydrogen flame. This causes the tubular opening to collapse around the current lead-in to form a gas-tight. mechanically stable connection. A photomicrograph of the connection site between the glass capsule and the current lead-in no longer showed any transition lines between the composite material and the layer of $SiO_2$ or between the layer of $SiO_2$ and the glass capsule due to such inhomogeneities as pores, cracks, or structural differences, but rather only a uniform $SiO_2$ phase could be seen.

EXAMPLE 2

An extruded strand of composite material is produced as described in Example 1, but in this case the material is incrementally heated to a final sustained temperature of 1,300° C. The strand of composite material is calcined in air for 30 minutes at 1,620° C. At the beginning of the calcining process, vaporization of ruthenium oxide is briefly observed. After it has cooled, the composite material is found to be covered all around with a thin layer of $SiO_2$ and the current lead-in can be sealed into a tubular opening of the glass capsule as described in Example 1.

EXAMPLE 3

A noble metal powder consisting of ruthenium with a BET specific surface of 0.29 $m^2/g$ and an average particle size $d_{50}$ of 5.0 $\mu$m is used to produce the powder mixture. The $SiO_2$ used to produce the powder mixture has a BET specific surface of 53 $m^2/g$ and an average particle size $d_{50}$ of 4.4 $\mu$m. 88 vol. % of the $SiO_2$ powder and 12 vol. % of the noble metal powder are homogeneously mixed with distilled water and worked into a paste. The paste is extruded into a strand with a diameter of 2.5 mm, which is then dried in air. The dried strand is heated to 1,300° C. in an inert atmosphere, preferably argon, at a maximum heating rate of 15° C./minute. Incremental heating is realized by maintaining the material at a constant temperature for 30 minutes at 500° C., 800° C., and 1,100° C. The final temperature of 1,300° C. is maintained for 2 h. The strand of composite material is calcined in air for 30 minutes at 1,620° C. At the beginning of the calcining process, vaporization of ruthenium oxide is briefly observed. After it has cooled, the composite material is found to be covered all around with a thin layer of $SiO_2$.

The layer of $SiO_2$ is removed from the ends of the current lead-in produced in this way, and an electrical conductivity test is performed. A measured conductivity value of 0.047 $m/\Omega mm^2$ was recorded.

EXAMPLE 4

The current lead-in from Example 2 with a diameter of 1.9 mm was tested for its current-carrying capacity. The rod-shaped current lead-in was mounted between two copper clips in air, and current was applied. The current could be increased to 20 amperes, which caused the temperature of the current lead-in to increase to about 1,700° C. The current lead-in did not melt through until the current was increased to 22 amperes. This gives a possible current density for the tested current lead-in of a respectable 7.05 $A/mm^2$.

EXAMPLE 5

A noble metal powder consisting of ruthenium with a BET specific surface of 0.96 $m^2/g$ and an average particle size $d_{50}$ of 9.4 $\mu$m is used to produce the powder mixture. The $SiO_2$ used to produce the powder mixture has a BET specific surface of 53 $m^2/g$ and an average particle size $d_{50}$ of 4.4 $\mu$m. 75 vol. % of the $SiO_2$ powder and 25 vol. % of the noble metal powder are homogeneously mixed with distilled water and worked into a paste. The paste is extruded into a strand with a diameter of 2.5 mm, which is then dried in air. The dried strand is heated to 1,300° C. in an inert atmosphere, preferably argon, at a maximum heating rate of 15° C./minute. Incremental heating is realized by maintaining the material at a constant temperature for 30 minutes at 500° C., 800° C., and 1,100° C. The final temperature of 1,300° C. is maintained for 2 h. After it has cooled, the current lead-in is cut to a length of 15 mm, and a blind hole 3 mm deep and 1 mm in diameter is drilled into each end of the strand of composite material. A tungsten wire electrode is inserted in one of the holes, and a molybdenum contact pin is inserted in the other hole. The surface of the strand of composite material is then covered with a thin, uniform layer of a paste produced by adding distilled water to the $SiO_2$ with a BET specific surface of 53 $m^2/g$ and an average particle size of 4.4 $\mu$m. The paste is dried in air and fired on the strand of composite material, which is fitted with the electrode and the contact pin, at 1,550° C. for 30 minutes.

An electrically conductive, mechanically stable connection is produced between the composite material and the electrode and between the composite material and the contact pin.

EXAMPLE 6

A noble metal powder consisting of ruthenium with a BET specific surface of 0.96 $m^2/g$ and an average particle size $d_{50}$ of 9.4 $\mu$m is used to produce the powder mixture. The $SiO_2$ used to produce the powder mixture has a BET specific surface of 53 $m^2/g$ and an average particle size $d_{50}$ of 4.4 $\mu$m. 75 vol. % of the $SiO_2$ powder and 25 vol. % of the noble metal powder are homogeneously mixed with distilled water and worked into a paste. The paste is extruded into a strand with a diameter of 2.5 mm, which is then dried in air. The dried strand is heated to 1,300° C. in an inert atmosphere, preferably argon, at a maximum heating rate of 15° C./minute. Incremental heating is realized by maintaining the material at a constant temperature for 30 minutes at 500° C., 800° C., and 1,100° C. The final temperature of 1,300° C. is maintained for 2 h. The strand of composite material is cooled, cut to a length of 15 mm and then calcined for 30 minutes in air at 1,620° C. At the beginning of the calcining process, vaporization of ruthenium oxide is briefly observed. After it has cooled, the composite material is found to be covered all around with a thin layer of $SiO_2$. The current lead-in is heated at one end to 1,500° C., and then a tungsten wire electrode is pressed about 2 mm into the viscous composite material. The contact pin is inserted in the other end of the composite material in the same way.

An electrically conductive, mechanically stable connection is produced between the composite material and the electrode and between the composite material and the contact pin.

We claim:

1. An $SiO_2$-glass bulb comprising: a discharge tube; and at least one current lead-in made of a gas-tight composite material, the composite material consisting of a noble metal with a melting point >1,700° C. and $SiO_2$, and is at least partially coated with a layer of $SiO_2$, the noble metal and the $SiO_2$ being homogeneously distributed in the composite material, the noble metal content of the composite material is ≧10 vol. % to ≦50 vol. %, the $SiO_2$ coating covering the composite material at least in a region of a connection with the discharge tube.

2. An $SiO_2$-glass bulb in accordance with claim 1, wherein the composite material is formed by heating a powder mixture that is composed of noble metal powder and $SiO_2$-glass powder.

3. An $SiO_2$-glass bulb in accordance with claim 1, wherein the noble metal is a noble metal alloy.

4. An $SiO_2$-glass bulb in accordance with any of claim 1, wherein the noble metal is at least one of platinum and rhodium.

5. An $SiO_2$-glass bulb in accordance with claim 1, the noble metal is at least one of ruthenium, rhenium and iridium.

6. An $SiO_2$-glass bulb in accordance with claim 1, wherein the current lead-in has an electrical conductivity of >0.01 m/Ω $mm^2$.

7. An $SiO_2$-glass bulb in accordance with claim 1, wherein the $SiO_2$ coating has a thickness of 5–25 $\mu$m.

8. An $SiO_2$-glass bulb in accordance with claim 7, wherein the thickness of the $SiO_2$ coating is 7≧15 $\mu$m.

9. An $SiO_2$-glass bulb in accordance with claim 2, wherein the noble metal powder has a BET specific surface of 0.01 to 10 $m^2/g$.

10. An $SiO_2$-glass bulb in accordance with claim 2, wherein the noble metal powder has an average particle size ($d_{50}$) of 3 to 30 $\mu$m.

11. An $SiO_2$-glass bulb in accordance with claim 2, wherein the $SiO_2$-glass powder has a BET specific surface of 10 to 100 $m^2/g$.

12. An $SiO_2$-glass bulb in accordance with claim 2, wherein the $SiO_2$-glass powder has an average particle size ($d_{50}$) of 0.1 to 10 $\mu$m.

13. An $SiO_2$-glass bulb in accordance with claim 1, wherein the composite material has a noble metal content that is ≧10 vol. % to ≦25 vol. %.

14. A high-intensity discharge lamp comprising an $SiO_2$-glass bulb having a discharge tube and at least one current lead-in made of a gas-tight composite material, the composite material consisting of a noble metal with a melting point >1,700° C. and $SiO_2$, and is at least partially coated with a layer of $SiO_2$, the noble metal and the $SiO_2$ being homogeneously distributed in the composite material, the noble metal content of the composite material is ≧10 vol. % to ≦50 vol. %, the $SiO_2$ coating covering the composite material at least in a region of a connection with the discharge tube.

* * * * *